US005446790A

United States Patent [19]

Tanaka et al.

[11] Patent Number: 5,446,790

[45] Date of Patent: Aug. 29, 1995

[54] INTAKE SOUND CONTROL APPARATUS

[75] Inventors: Katsuyuki Tanaka, Nukata; Masanori Kato, Seto; Kouzi Ohara, Nukata; Tokio Kohama, Nishio; Yoshitaka Nishio, Nagoya, all of Japan

[73] Assignee: Nippondenso Co., Ltd., Kariya, Japan

[21] Appl. No.: 165,579

[22] Filed: Dec. 13, 1993

Related U.S. Application Data

[63] Continuation of Ser. No. 35,881, Mar. 23, 1993, which is a continuation of Ser. No. 617,074, Nov. 23, 1990, abandoned.

[30] Foreign Application Priority Data

Nov. 24, 1989 [JP] Japan ..... 1-305668

[51] Int. Cl.[6] ..... G10K 11/16

[52] U.S. Cl. ..... 381/71; 181/206; 181/228

[58] Field of Search ..... 381/71; 181/206, 228

[56] References Cited

U.S. PATENT DOCUMENTS

| | | | |
|---|---|---|---|
| 3,254,484 | 6/1966 | Kopper | 181/206 |
| 4,506,380 | 3/1985 | Matsui | 381/71 |
| 4,546,733 | 12/1985 | Fukami et al. | 181/229 |
| 4,800,985 | 1/1989 | Hanzawa et al. | 181/229 |
| 4,805,733 | 2/1989 | Kato et al. | 381/71 |
| 4,878,188 | 10/1989 | Ziegler, Jr. | 381/71 |
| 4,947,434 | 8/1990 | Ito | 381/71 |
| 5,097,923 | 3/1992 | Ziegler et al. | 381/71 |
| 5,119,427 | 6/1992 | Hersh | 381/71 |
| 5,170,433 | 12/1992 | Elliott et al. | 381/71 |

*Primary Examiner*—Forester W. Isen

*Attorney, Agent, or Firm*—Cushman, Darby & Cushman

[57] ABSTRACT

A device for cancelling annoying sounds caused by operation of an internal combustion engine. An intake sound of the engine, and also a rotational speed of the engine, are obtained. The phase difference between the present intake sound and a desired intake sound is obtained using map data. The map data depends on the rotational speed of the engine and is specifically calculated so that at least the (n+0.5) harmonics (n integer≧0) are cancelled. The phase data is used to drive a ceramic speaker or two oppositely directed ceramic speakers, to appropriately compensate the input sound.

19 Claims, 5 Drawing Sheets

INTAKE SOUND CONTROL APPARATUS

This is a continuation of application Ser. No. 08/035,881, filed on Mar. 23, 1993 , which was abandoned upon filing hereof; which was a continuation of Ser. No. 07/617,074 filed Nov. 23, 1990, now abandoned.

BACKGROUND OF THE INVENTION

1. Field of the Invention

This invention relates to intake sound control apparatus especially for providing an even intake sound in an intake pipe of an internal combustion engine.

2. Description of the Prior Art

According to conventional apparatus, a muffler such as a resonator has been provided in the intake pipe for reducing intake noise in an internal combustion engine.

However, since the capacity of such a resonator is limited to a fixed value, an appropriate frequency for eliminating the noise is limited to a particular band. Accordingly, such apparatus does not select the a noise frequency which changes in response to engine speed.

Considering such problem, Toku-Kai-Sho (Laid open publication of Japanese Patent application) 59-3157 discloses an apparatus which includes a plurality of resonators, each of which has a different capacity, and a rotary valve which is provided in a common connecting passage for these resonators and which changes in response to the rotation speed of the engine.

However, according to this structure, there is another problem in that such apparatus needs too large of a space because of a number of resonators when put in a small room such as an engine room.

On the other hand, as a result of our enthusiastic research, it has been determined that noise frequencies having (n+0.5) harmonics of engine rotation speed as well as a noise frequency having a secondary component of engine rotation speed cause an unusual noise especially when the rotation speed is accelerated or decelerated, but that an even sound, which does not provide an uncomfortable feeling, can be obtained by eliminating noise having such frequencies.

SUMMARY OF THE INVENTION

An object of the present invention is to provide an intake sound control apparatus which reduces the intake noise level and provides an even intake sound having the feeling of a linear changing sound.

For the purpose of achieving the object, an intake sound control apparatus according to the present invention has the following structure. Namely, the apparatus includes rotation speed detecting means for directly or indirectly detecting the rotation speed of an internal combustion engine and calculating means for calculating, in response to the detected rotation speed, a desired frequency and for producing a calculated signal. The apparatus further includes acoustic sound generating means for generating an in phase or an inverse phase sound on the basis of the calculated signal.

DETAILED DESCRIPTION OF THE EMBODIMENTS

Figure 1:
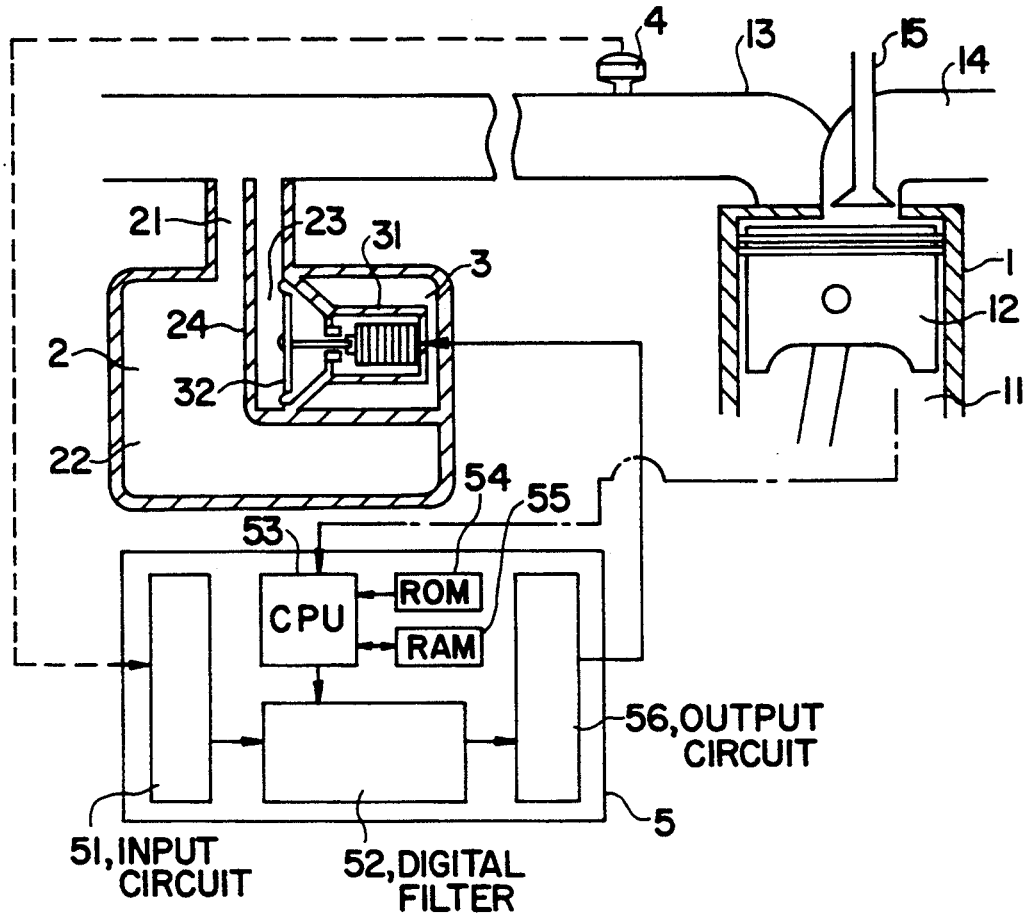
FIG. 1 is a block diagram showing a first embodiment of the present invention.
Figure 4A:
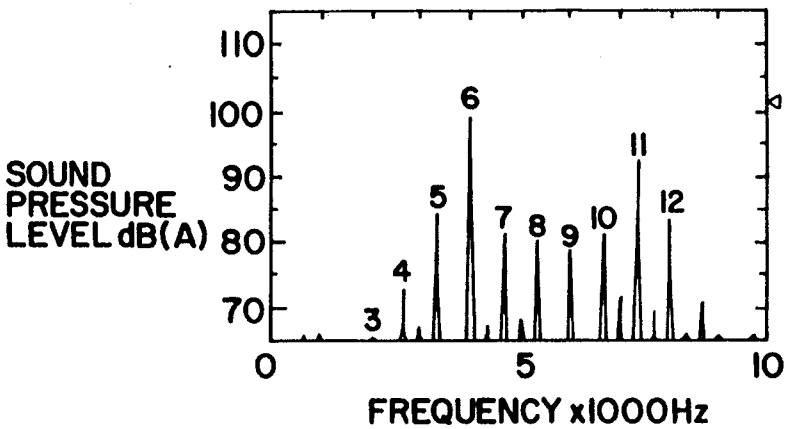
FIGS. 4 (*a*) and (*b*) are diagrams respectively showing frequency analysis of FIGS. 3 (*a*) and (*b*) when the rotation speed of the engine is 4000 rpm.
Figure 4B:
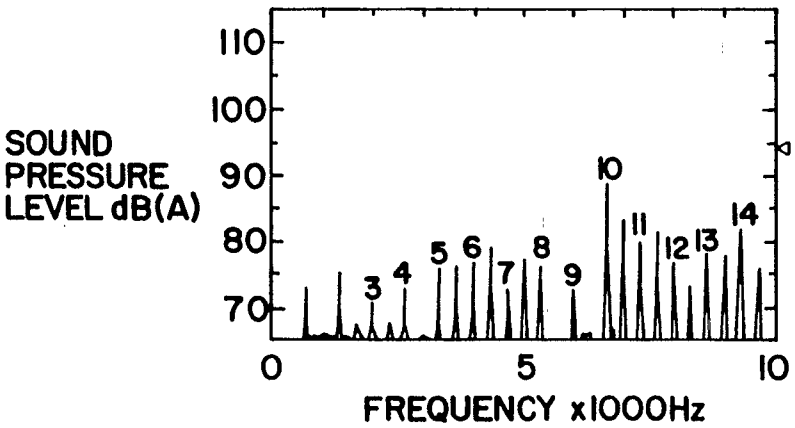

The present invention is explained by using a first embodiment with reference to the drawings. Reference numeral 1 denotes an internal combustion engine which includes a cylinder 11, a piston 12 provided within the cylinder 11, an intake pipe 13 and an exhaust pipe 14 both of which are fixed to the cylinder 11. Reference numeral 15 denotes a valve for opening and closing the intake pipe 13 and the exhaust pipe 14.

Reference numeral 2 denotes a resonator which includes a small diameter portion 21 coupled to the intake pipe 13 and a hollow portion 22 coupled to the small diameter portion 21. Within the hollow portion 22, a wall 24 is formed in order to separate a first hollow portion 23 from the other space of the hollow portion. The first hollow portion communicates with the intake pipe.

Reference numeral 3 designates a cancelling speaker accommodated in the first hollow portion 23.

The cancelling speaker 3 is a compact ceramic speaker for producing high-power sound, which includes a PZT (lead zirconate titanate) actuator 31 in order to make a vibrator 32 vibrate. A cancelling sound is produced by the vibration of the vibrator. An intake pressure sensor 4 is provided downstream of the resonator in the intake pipe 13 for the purpose of sensing the intake sound within the intake pipe 13.

Reference numeral 5 denotes a control circuit as calculating means for controlling the intake noise, which includes an input circuit 51 for receiving a signal from the intake pressure sensor 4, digital filter 52, an output circuit 56 for generating a signal to the cancelling speaker 3, a CPU 53, a ROM 54 and a RAM 55.

Figure 2:
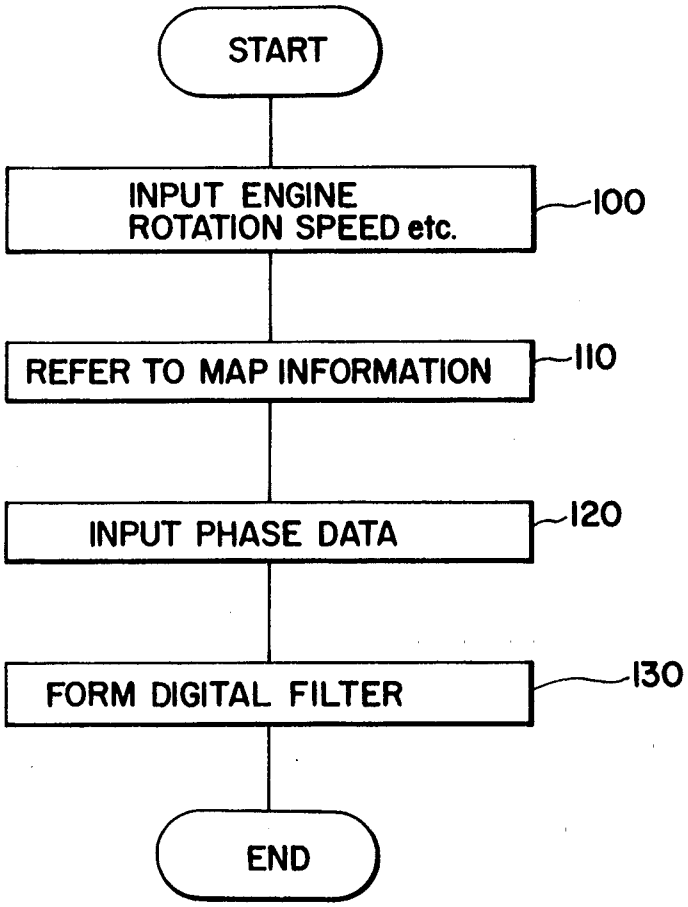
FIG. 2 is a flow chart showing a calculation program carried out by a CPU.

Operation of the apparatus having the above-described configuration is explained below. An intake wave shape detected by the intake pressure sensor is applied to the input circuit 51, filtered and amplified by the input circuit 51. The filtered and amplified signal is sent to the digital filter 52 so as to control phases with respect to necessary frequency components such as second and (n+0.5) harmonics (n is an integer and $n \geqq 0$) and of the engine rotation speed an acoustic wave from the cancelling speaker 3 is produced on the basis of the detected signal from the intake pressure sensor 4. In this case, digital filter 52 forms each filter characteristic for each predetermined rotation speed in response to commands from the CPU 53. The CPU 53 takes engine rotation speed data in a step 100 shown in FIG. 2 and detects memorized map data on the basis of the engine rotation speed data in a step 110. Then, the CPU 53 takes phase data corresponding to the secondary and (n+0.5) harmonics from the ROM 54. In this case, each phase data is formed in accordance with each intake system of each internal combustion engine.

The filter characteristic is formed by the digital filter 52 based on phase data. After the intake wave signal is passed through such filter characteristic, the passed signal is amplified by the output circuit 56 and then is supplied to the cancelling speaker 3.

Accordingly, when an acoustic wave identical with that detected by the intake pressure sensor 4 reaches resonator 2, the cancelling speaker 3 generates an acoustic wave having an inverse phase which interferes with such acoustic wave so that only unnecessary components are eliminated. Since the noise level is reduced and an uncomfortable sound which is considered that it occurs by the interference with the (n+0.5)th harmonics is eliminated, an even sound is obtained.

If an uncomfortable sound having (n+0.5) harmonics of the rotation speed "S" rpm occurs, the corresponding frequency equals to S(n+0.5)/60(Hz). For example, a frequency having the 5 to 6.5 harmonics of the rotation speed 4000 rpm equals to 300 to 433 Hz. The phase of such frequency is controlled so that it becomes an inverse phase to the phase of the original acoustic wave.

According to the present embodiment, medium and high frequency noise is changed to an even sound having a changing feeling by the above-described control. On the other hand, low frequency noise is resonated by the hollow portion 22 and therefore reduced. Therefore the resonator according to the present embodiment does not need a large scale and high power speaker for the purpose of reducing the low frequency noise.

Figure 3A:
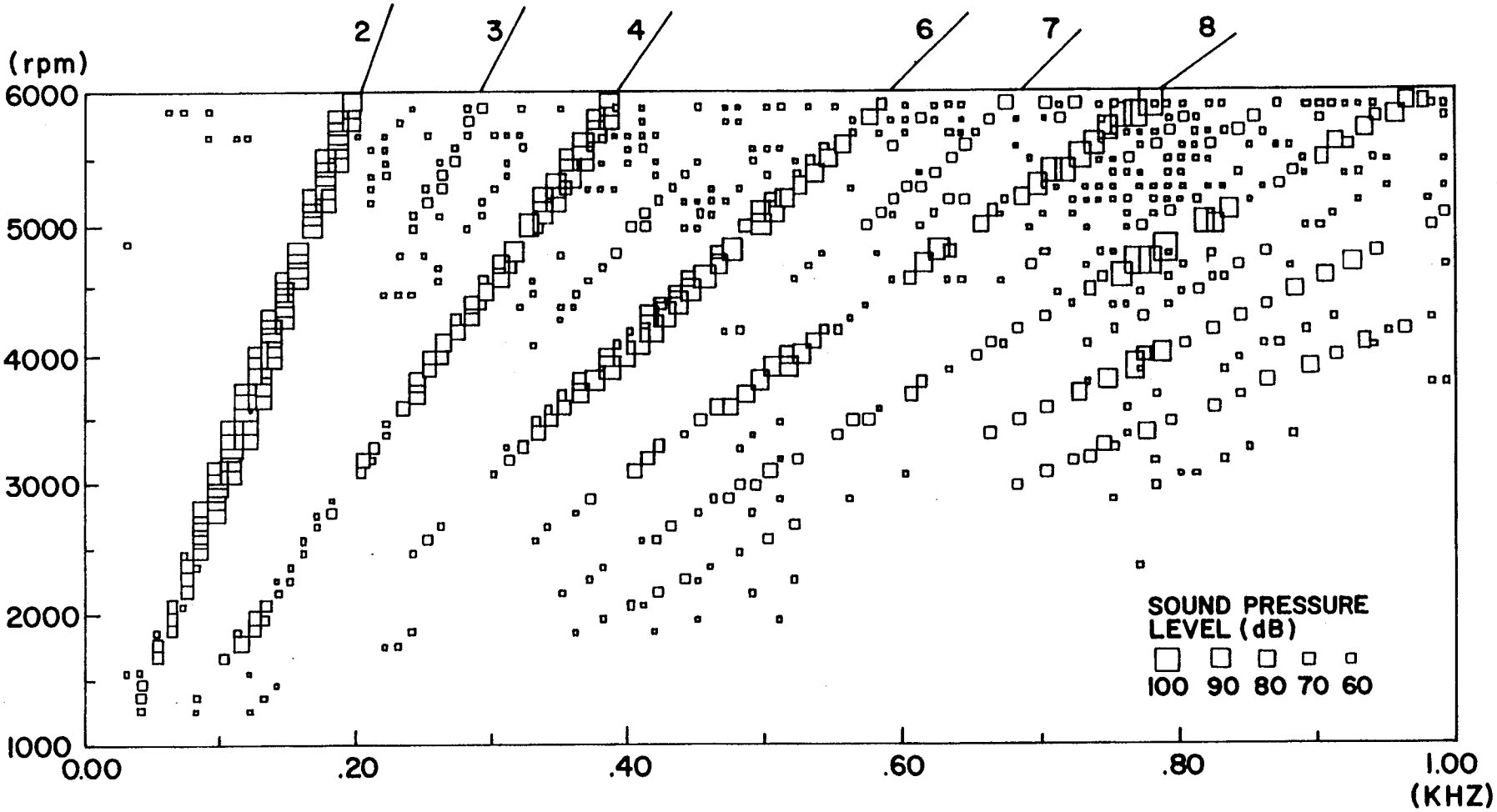
FIGS. 3 (*a*) and (*b*) are Cambell diagrams respectively showing a result of frequency analyses using the present invention and a result using the conventional technique.
Figure 3B:
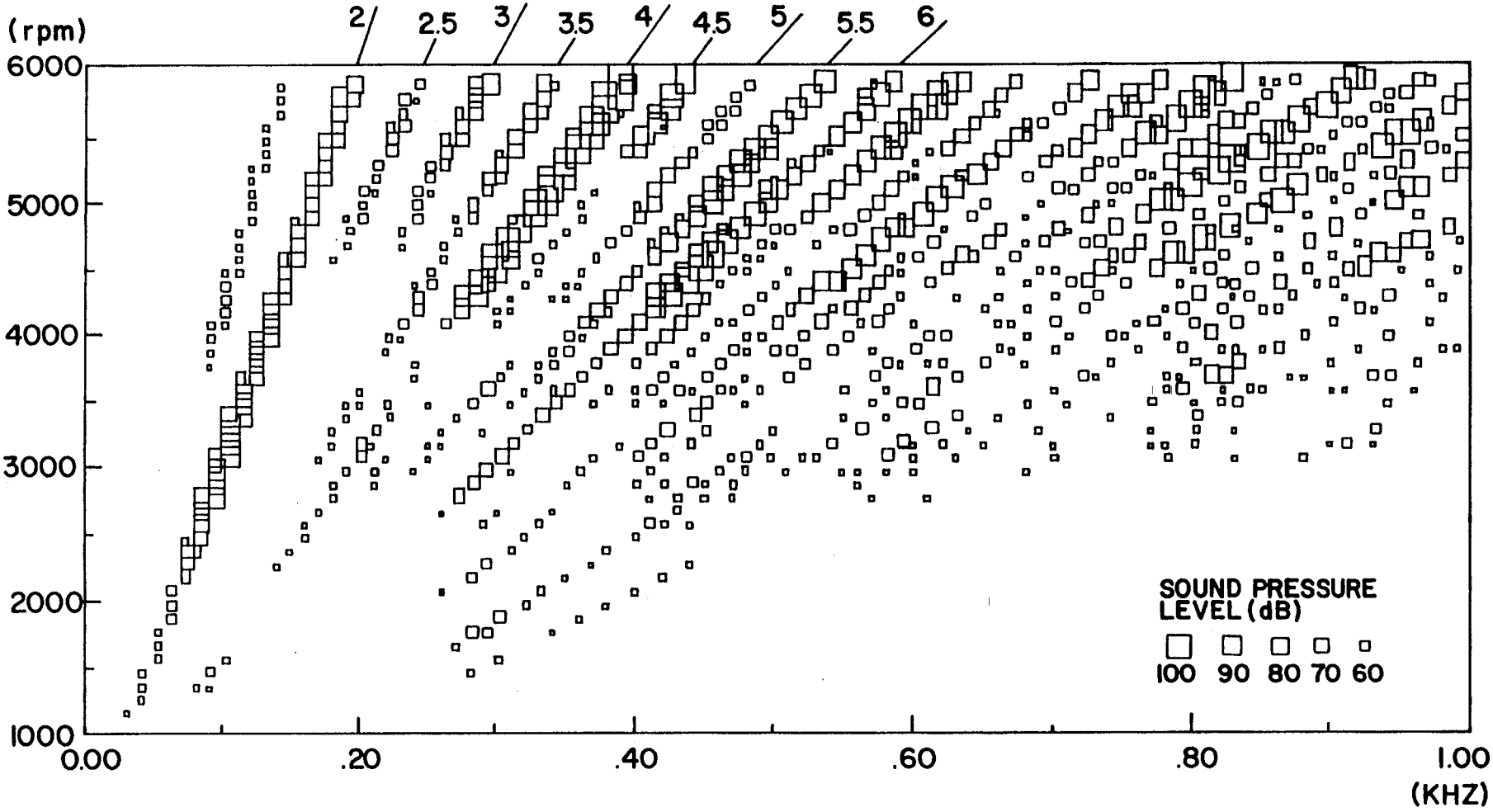

In FIGS. 3 (*a*) and (*b*), the horizontal line indicates the frequency and the vertical line indicates the rotation speed of the engine. The sound pressure is expressed by the squares. Reference numerals shown in the upper portions of the drawings denote the degree components, namely the harmonics of the engine frequency. When the rotation speed of the engine is 6000 rpm, engine frequency becomes 100 Hz. In this case, its second harmonics is 200 Hz. As clearly shown in FIG. 3 (*a*), there is only a little noise having the (n+0.5) harmonic according to the present invention. Noise having the (n+0.5) harmonic shown in FIGS. 3 (*b*) and 4 (*b*) is one of the factors which create uncomfortable noise in a vehicle compartment. So, when such noise is eliminated as shown in FIGS. 3 (*a*) and 4 (*a*), a comfortable sound is obtained.

Figure 5:
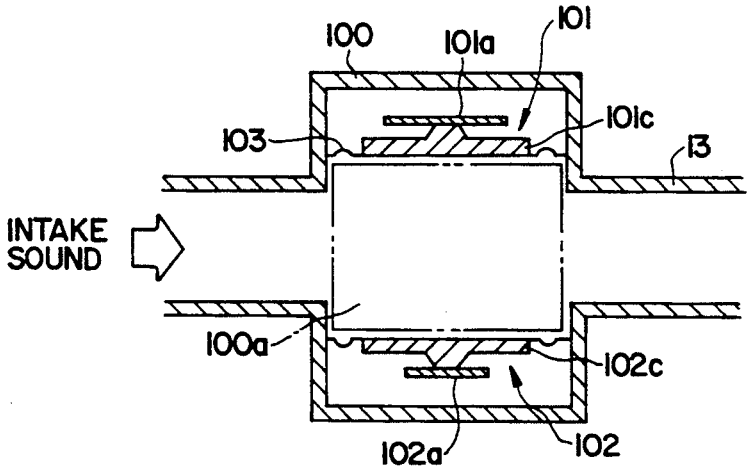
FIG. 5 is a sectional view showing a second embodiment of the present invention.
Figure 6:
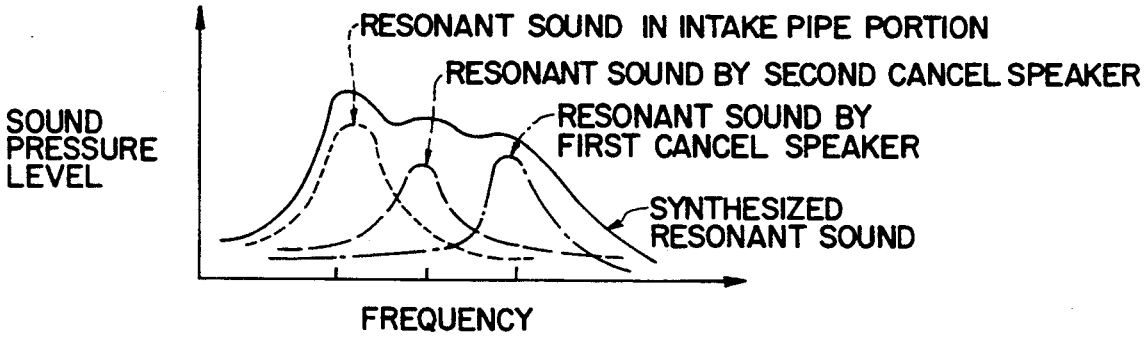
FIG. 6 is a diagram showing a characteristics of the second embodiment.

A configuration of a second embodiment is explained with reference to FIG. 5. According to the second embodiment, a resonator 100 is formed on the intake pipe 13 by making a part of the intake pipe 13 thick. First and second cancelling speakers 101 and 102 are provided within resonator 100 so that one cancelling speaker faces toward the other through the intake pipe portion 100*a* which is formed in the center of the resonator 100. Both cancelling speakers 101 and 102 are comprised of circular and extremely thin materials. For instance, the first cancelling speaker 101 includes a PZT element 101*a* having a diameter of 5 cm and a radiation board 101*c* which is comprised of a light weight and low specific gravity material such as a forming material or a bimorph material and is coupled to the center portion of the PZT element 101*a*. In the same way, the second cancelling speaker 102 includes a PZT element 102*a* having the diameter of 4 cm and a radiation board 102*c* which is comprised of the same material as the radiation board 101*c* and is coupled to the center portion of the PZT element 102*a*.

The intake pipe portion 100*a* is separated by an absorber 103 from an acoustic wave generating portion 100*h* which is formed within an outer circumference of the resonator 100. Accordingly, both radiation boards 101*c* and 102*c* are provided in the acoustic wave generating portion 100*h*. The vibrations of the bimorph elements 101*a* and 102*a* are easily transferred by the absorber 103 into the intake pipe portion 100*a*.

The control of the cancelling speakers 101 and 102 are carried out on the basis of a signal from an engine rotation speed sensor, which is not shown in the drawings, because the frequency of the intake sound depends on only the engine rotation speed. Namely, a control circuit of the second embodiment calculates each phase change value to a low frequency band, medium frequency band, and high frequency band of the intake sound by using a predetermined map data on the basis of the detected engine rotation speed from the engine rotation speed sensor. After that, the medium frequency and the high frequency of the intake sound are respectively resonated by the cancelling speaker 101 in response to the calculated value.

In the second embodiment, two PZT bimorph elements having different resonant frequencies are provided in the resonator 100 so that they surround the intake pipe portion 100*a*. Accordingly, because the low frequency, the medium frequency, and the high frequency are respectively resonated by the intake pipe portion 100*a*, the first cancelling speaker 101 and the second cancelling speaker 102, a synthetic resonant sound to a wide frequency band is obtained. As the result of the above-described resonances, a desired intake sound, namely an even sound having a linear feeling is obtained by the wide range frequency control. In addition to this characteristic, since the cancelling speakers are composed of extremely thin PZT elements and light weight radiation boards, a low frequency and large capacity sound can be obtained regardless of the compact size speakers. Further, since the intake pipe portion exists between the cancelling speakers, the resonance between the speaker sound and the intake sound can be effectively controlled.

Figure 7:
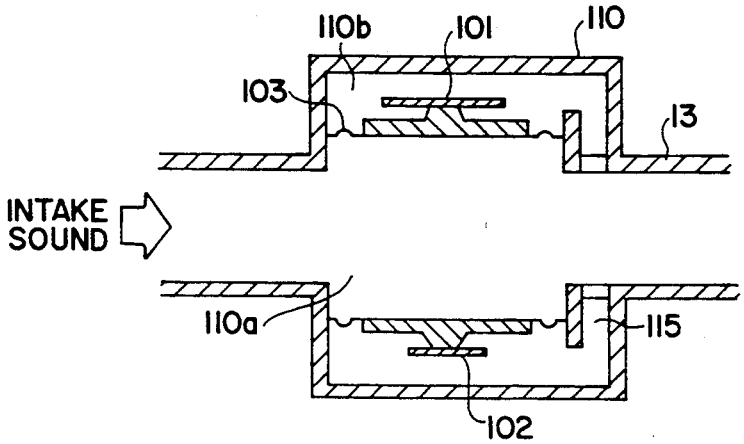
FIG. 7 is a sectional view of a third embodiment of the present invention.

FIG. 7 shows a configuration of a resonator according to a third embodiment. In FIG. 7, the same members are designated by the same reference numerals. In the third embodiment, connecting port 115 is formed so that the acoustic wave generating portion 110*b* directly connects with the intake pipe 13.

The connecting port 115 prevents the air within the acoustic wave generating portion 110*b* from interfering with the movement of the vibration boards when the cancelling speakers 101 and 102 generate the cancelling sound. Since a sound generated from the acoustic wave generating portion 110*b* is of inverse phase to the sound in the intake pipe 13, a sound generated from the back sides of the cancelling speakers 101 and 102 becomes inverse in phase by the presence of the acoustic wave generating portion 110*b* and the connecting port 115. Therefore, the cancelling sound from the cancelling speaker can be effectively transferred to the intake sound according to the third embodiment.

The noise control device is not limited to the digital filter 52 in the first embodiment. A combination of delay elements can be applied in order to eliminate unnecessary components of the noise.

The cancelling speaker is not limited to a PZT speaker. It is obvious that its position is not limited to the inside of the resonator 2. It may be provided in another position in the intake system if such position is appropriate for eliminating the noise.

The engine intake sound can be indirectly detected by the engine rotation pulse and other factors such as engine load condition. The indirectly detected intake sound may be used for the noise control in which the cancelling speaker 3 generates the cancelling sound having an inverse phase.

We claim:

1. An intake sound control apparatus for an internal combustion engine which has an intake passage, comprising:

detecting means for detecting an intake sound and a rotational speed of said internal combustion engine;

a resonator, provided in said intake passage, for resonating frequency components of said intake sound;

control means for producing a sound signal on the basis of a detected intake sound by said detecting means, said sound signal having characteristics for cancelling at least a sound having plural harmonics having frequencies (n+0.5) times a detected rotating speed by said detecting means, where n is an integer and $n \geqq 0$;

cancelling sound generating means provided in said resonator, acoustically coupled to said intake passage for generating a cancelling sound on the basis of said sound signal.

2. An apparatus according to claim 1, wherein said sound signal also has characteristics for cancelling a sound having secondary harmonics of said detected rotation speed.

3. An apparatus according to claim 1, wherein said control means comprises:

processing means for obtaining phase data corresponding to the (n+0.5) harmonics on the basis of said detected rotation speed; and filter means for filtering said detected intake sound using a filter characteristic formed based on said phase data.

4. An apparatus according to claim 3, wherein said processing means includes memory means for storing a map of phase data corresponding to each rotation speed, and means for accessing said phase data from said memory means on the basis of said detected rotation speed.

5. An apparatus according to claim 1, wherein said cancelling sound generating means includes a compact speaker of a ceramic type.

6. An apparatus according to claim 1, wherein said detecting means comprises an intake sound detecting means which determines said sound of the engine and means, responsive to said intake sound detecting means, for determining said engine rotation speed.

7. An apparatus according to claim 1, wherein said cancelling sound generating means comprises two speakers facing one another.

8. An apparatus according to claim 7, further comprising a connection port between a rear side of said speakers and an area in which said cancelling sound is to be generated.

9. An apparatus according to claim 1, wherein said cancelling sound includes first frequency components, said resonator resonates second frequency components of said intake sound,and said second frequency components are different from said first frequency components.

10. An apparatus according to claim 1, wherein said resonator includes a wall defining first and second hollow portions on opposite sides thereof, said second frequency components being resonated by said first hollow portion and said acoustic wave generating means being provided in said second hollow portion.

11. An apparatus according to claim 1, wherein said control means includes a digital filter for forming phases corresponding to the second and (N+0.5) harmonics of a detected rotating speed detected by said detecting means.

12. An apparatus according to claim 1, wherein said integer n is equal to at least two.

13. An intake sound control apparatus for an internal combustion engine which has an intake passage, comprising:

a sensor which detects an intake sound of said internal combustion engine;

means for determining a rotational speed of said internal combustion engine; sound cancelling means, receiving said intake sound and said rotational speed, for processing said intake sound based on said rotational speed to produce a sound signal having characteristics for changing sound pressure levels of at least first frequency components of said intake sound, said sound signal produced from said intake sound;

a resonator, provided in said intake passage, for resonating second frequency components of said intake sound, said second frequency components being different from said first frequency components; and acoustic wave generating means provided in said resonator, acoustically coupled to said intake passage, for generating an acoustic wave corresponding to said sound signal;

wherein said resonator includes a wall defining first and second hollow portions on opposite sides thereof, said second frequency components being resonated by said first hollow portion and said acoustic wave generating means being provided in said second hollow portion.

14. An apparatus according to claim 13, wherein said first hollow portion resonates at an amount to cancel a low frequency noise, and said cancelling sound generating means is provided in said second hollow portion and cancels medium and high frequency noise.

15. An apparatus according to claim 13, wherein said first hollow portion resonates at least an amount to cancel a low frequency noise and said acoustic wave generating means provided in said second hollow portion cancels medium and high frequency noise.

16. An intake sound control apparatus for an internal combustion engine which has an intake passage, comprising:

a resonator, provided in said intake passage of an internal combustion engine, for resonating in accordance with first frequency components of an intake sound;

a sensor which detects an intake sound of said internal combustion engine;

sound cancelling means, receiving said intake sound, for altering characteristics of said intake sound to produce a sound signal having characteristics for changing sound pressure levels of at least said first frequency components of said intake sound, said sound signal being produced from said intake sound; and acoustic wave generating means provided in said resonator, acoustically coupled to said intake passage and receiving said sound signal as an input thereof, for generating an acoustic wave corresponding to said sound signal;

wherein said resonator includes a wall defining first and second hollow portions on opposite sides thereof, second frequency components different from said first frequency components, being resonated by said first hollow portion and said acoustic wave generating means being provided in said second hollow portion.

17. An apparatus according to claim 16, wherein said first hollow portion resonates a low frequency noise and said acoustic wave generating means provided in said second hollow portion produces acoustic waves to cancel medium and high frequency noise.

18. An apparatus according to claim 16, wherein said acoustic wave generating means comprises:

first means for cancelling a high frequency noise; and second means for cancelling a medium frequency.

19. An apparatus according to claim 16, wherein said acoustic wave generating means includes a speaker and a piezoelectric actuator for activating said speaker.

* * * * *

UNITED STATES PATENT AND TRADEMARK OFFICE
CERTIFICATE OF CORRECTION

PATENT NO. : 5,446,790

DATED : AUGUST 29, 1995

INVENTOR(S) : TANAKA et al

It is certified that error appears in the above-identified patent and that said Letters Patent is hereby corrected as shown below:

On title page, item [73] should read as follows:

"[73] Assignee: Nippondenso Co., Ltd., Kariya, Japan"

to

--[73] Assignee: Nippondenso Co., Ltd., Kariya, Japan and Nippon Soken, Inc., Nishio, Japan--.

Signed and Sealed this

Twelfth Day of November, 1996

*Attest:*

BRUCE LEHMAN

*Attesting Officer*

*Commissioner of Patents and Trademarks*